US009974393B1

(12) United States Patent
Lundquist

(10) Patent No.: US 9,974,393 B1
(45) Date of Patent: May 22, 2018

(54) CONVERTIBLE DISPLAY STAND TO SEATING ASSEMBLY

(71) Applicant: Carol Lundquist, Delano, MN (US)

(72) Inventor: Carol Lundquist, Delano, MN (US)

( * ) Notice: Subject to any disclaimer, the term of this patent is extended or adjusted under 35 U.S.C. 154(b) by 0 days. days.

(21) Appl. No.: 15/590,336

(22) Filed: May 9, 2017

(51) Int. Cl.

| | |
|---|---|
| ***F16M 11/00*** | (2006.01) |
| ***A47C 13/00*** | (2006.01) |
| ***F16M 11/32*** | (2006.01) |
| ***F16M 13/02*** | (2006.01) |
| *F16M 11/20* | (2006.01) |
| *F16M 13/00* | (2006.01) |

(52) U.S. Cl.
CPC ..... *A47C 13/005* (2013.01); *F16M 11/32* (2013.01); *F16M 13/02* (2013.01); *A47C 13/00* (2013.01); *F16M 11/20* (2013.01); *F16M 13/00* (2013.01)

(58) Field of Classification Search
USPC ..... 248/163.1
See application file for complete search history.

(56) References Cited

U.S. PATENT DOCUMENTS 1,492,048 A 4/1924 Reilly
D194,050 S 11/1962 Charpentier
3,879,889 A * 4/1975 Schmid ..... A01G 9/02 206/423
D237,568 S 11/1975 Nelson
D245,469 S 8/1977 Smilko
4,702,521 A * 10/1987 Bae ..... A47C 4/02 297/188.12
D316,687 S 5/1991 Wilby
5,150,804 A * 9/1992 Blanchet ..... B65D 21/0223 206/505
5,199,213 A * 4/1993 Krebs ..... A47G 7/041 248/146
5,309,670 A * 5/1994 Bates ..... A47G 7/02 248/346.11
5,439,269 A * 8/1995 Cheng ..... A47C 4/02 108/150
5,586,409 A 12/1996 Jamieson
5,762,004 A * 6/1998 Vashon ..... A47B 3/08 108/128
5,782,453 A * 7/1998 Tuzza ..... A47G 33/12 248/519
5,930,951 A * 8/1999 Wong ..... A01G 9/02 47/66.1
5,975,635 A * 11/1999 Parpala ..... A47C 9/10 297/188.08
6,027,084 A * 2/2000 Dressler ..... A47G 7/041 248/146
6,029,937 A * 2/2000 Funaro ..... A47G 7/041 248/146

(Continued)

FOREIGN PATENT DOCUMENTS

CN 202374767 U * 8/2012

*Primary Examiner* — Monica E Millner

(57) ABSTRACT

A convertible display stand to seating assembly for selectively seating a user and exhibiting a display item includes a stool and the display item. The stool comprises a plate and a plurality of legs. The legs are coupled to and extend from the plate. The display item is configured to be reversibly coupled to the plate. The legs are positioned on the plate so that the stool is configured to seat a user. The display item is positioned to be coupled to the plate so that the display item is configured to be exhibited upon the stool.

11 Claims, 4 Drawing Sheets

(56) References Cited

U.S. PATENT DOCUMENTS

| | | | | |
|---|---|---|---|---|
| 6,237,881 | B1 * | 5/2001 | Levesque | A47B 85/06 108/157.1 |
| D449,248 | S | 10/2001 | Jacobson | |
| 6,517,035 | B1 * | 2/2003 | Sellers | A47G 7/041 248/146 |
| 7,661,685 | B2 * | 2/2010 | Thibault | B25H 3/00 280/47.35 |
| 7,805,886 | B2 * | 10/2010 | Brandstatter | A01G 9/02 220/761 |
| 8,037,638 | B1 * | 10/2011 | McComb | A47G 7/07 248/27.8 |
| 8,789,885 | B2 | 7/2014 | Salensky | |
| 8,978,294 | B2 * | 3/2015 | Adams | A47G 7/02 47/39 |
| D736,538 | S | 8/2015 | Kester | |
| 2002/0153754 | A1 * | 10/2002 | Huang | A47C 3/04 297/239 |

* cited by examiner

CONVERTIBLE DISPLAY STAND TO SEATING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to convertible seating assemblies and more particularly pertains to a new convertible seating assembly for selectively seating a user and exhibiting a display item.

BRIEF SUMMARY OF THE INVENTION

An embodiment of the disclosure meets the needs presented above by generally comprising a stool and a display item. The stool comprises a plate and a plurality of legs. The legs are coupled to and extend from the plate. The display item is configured to be reversibly coupled to the plate. The legs are positioned on the plate so that the stool is configured to seat a user. The display item is positioned to be coupled to the plate so that the display item is configured to be exhibited upon the stool.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
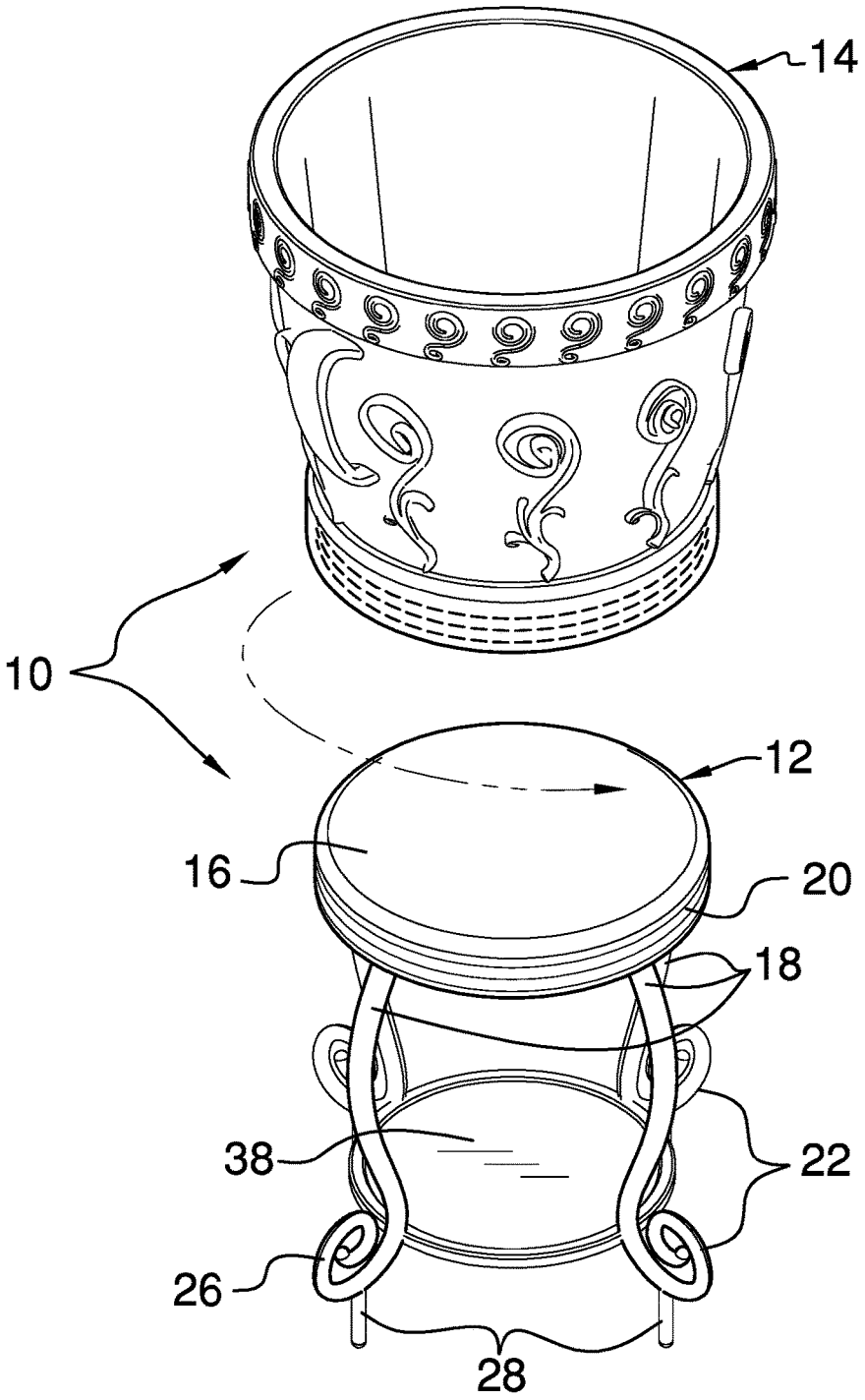
FIG. 1 is an exploded view of a convertible display stand to seating assembly according to an embodiment of the disclosure.
Figure 2:
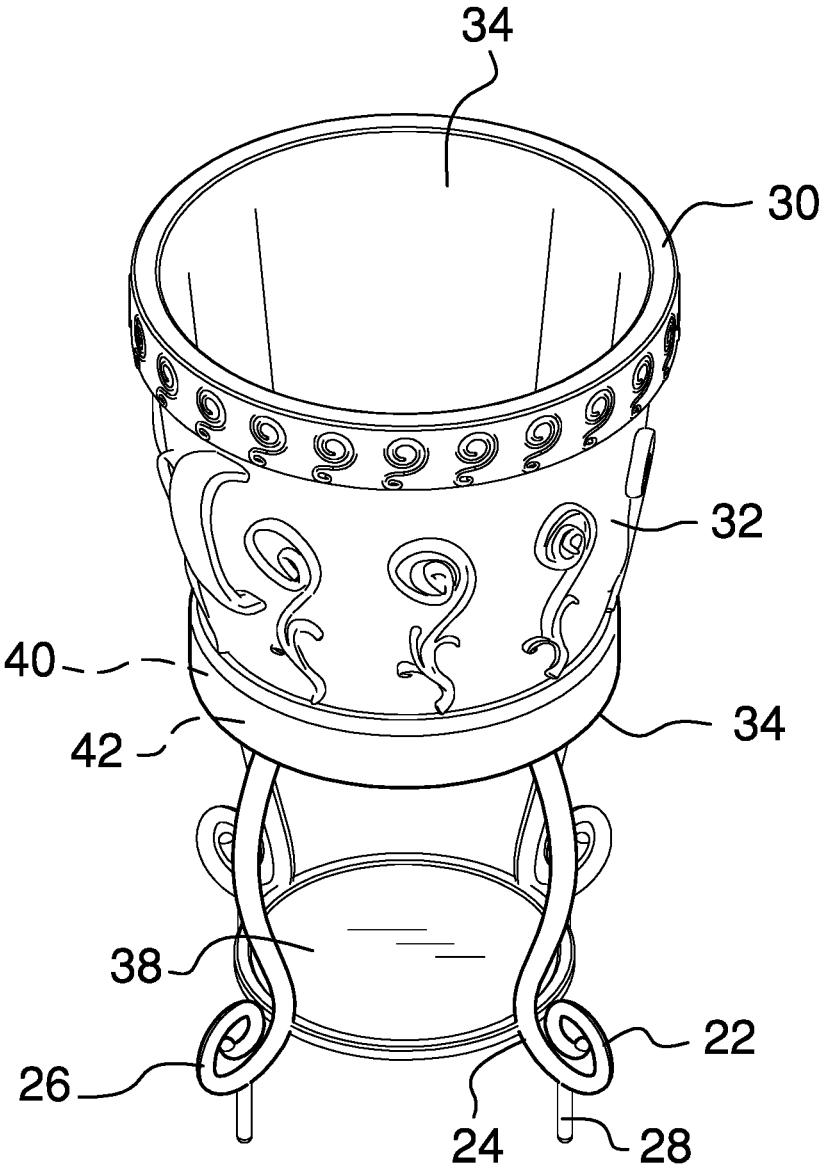
FIG. 2 is an isometric perspective view of an embodiment of the disclosure.
Figure 3:
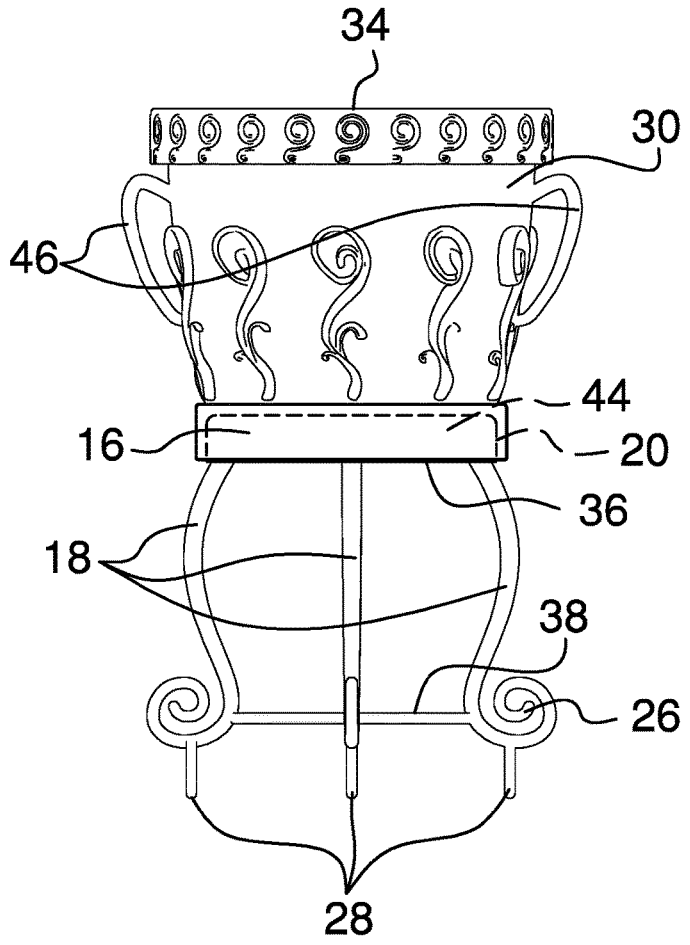
FIG. 3 is a side view of an embodiment of the disclosure.
Figure 4:
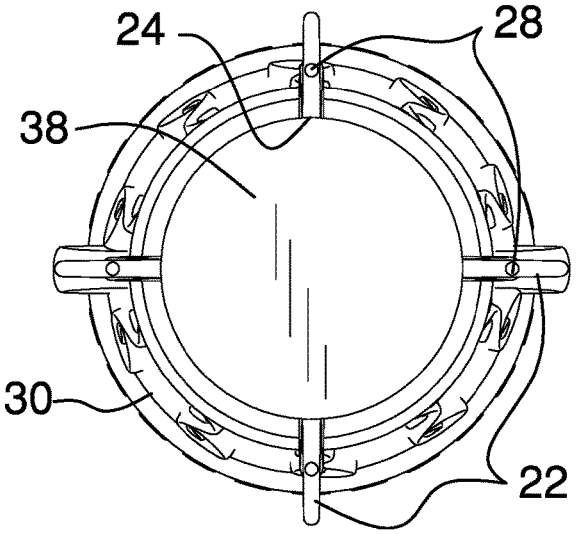
FIG. 4 is a bottom view of an embodiment of the disclosure.
Figure 5:
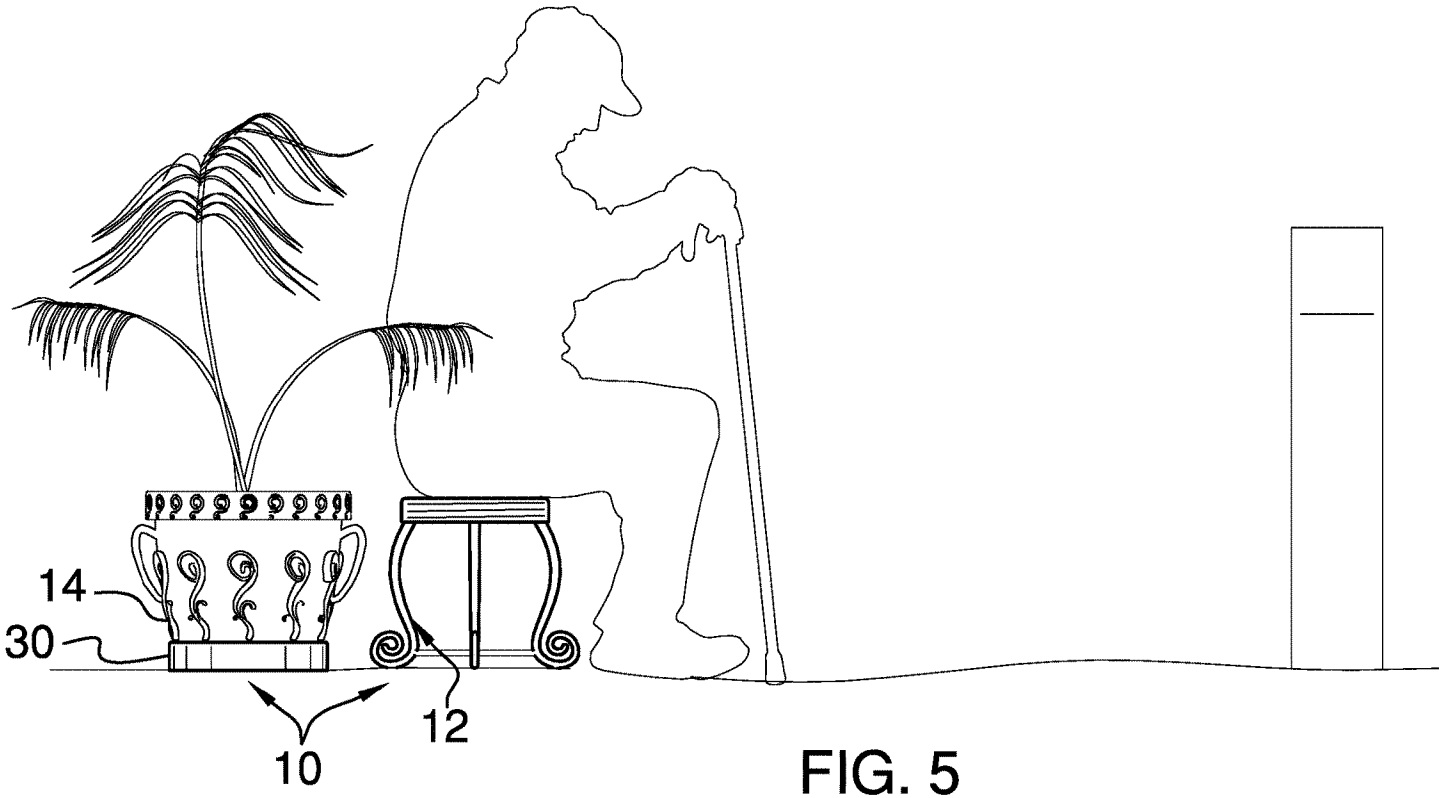
FIG. 5 is an in-use view of an embodiment of the disclosure.

With reference now to the drawings, and in particular to FIGS. 1 through 5 thereof, a new convertible seating assembly embodying the principles and concepts of an embodiment of the disclosure and generally designated by the reference numeral 10 will be described.

As best illustrated in FIGS. 1 through 5, the convertible display stand to seating assembly 10 generally comprises a stool 12 and a display item 14. The stool 12 comprises a plate 16 and a plurality of legs 18. The legs 18 are coupled to and extend from the plate 16. The stool 12 is configured to seat a user. In one embodiment, the plate 16 is circularly shaped. In another embodiment, the plate 16 has a sidewall 20. The sidewall 20 is externally threaded. In yet another embodiment, the plurality of legs 18 comprises four legs 18. In still yet another embodiment, the legs 18 extends arcuately from the plate 16.

Each of a plurality of extensions 22 is coupled to and extends arcuately from a bottom end 24 of a respective leg 18. Each extension 22 defines a spiral 26.

Each of a plurality of spikes 28 is coupled to and extends from a respective extension 22. The spikes 28 are substantially perpendicular to the plate 16. The spikes 28 are configured to insert into a surface, such as a lawn proximate to a grave site, to couple the stool 12 to the surface.

The display item 14 is configured to be reversibly coupled to the plate 16. The display item 14 is positioned to couple to the plate 16 so that the display item 14 is configured to be exhibited upon the stool 12. In one embodiment, the display item 14 comprises a pot 30. The pot 30 comprises an annular wall 32 that extends between an upper end 34 and a lower end 36. The upper end 34 is open so that the pot 30 is configured to insert at least one plant. The pot 30 is positioned to couple to the plate 16 so that the pot 30 and the at least one plant are configured to be exhibited upon the stool 12. In another embodiment, the lower end 36 is shaped complementarily to the plate 16. In yet another embodiment, the upper end 34 is dimensionally larger than the lower end 36 so that the annular wall 32 is tapered.

A panel 38 is coupled to and extends between the bottom ends 24 the legs 18. The panel 38 is configured to cover the surface, such as a section of the lawn proximate to the grave site, upon which the stool 12 is positioned.

In one embodiment of the invention, a plurality of first couplers 40 is coupled to the plate 16. A plurality of second couplers 42 is coupled to the display item 14. The second couplers 42 are complementary to the first couplers 40. The second couplers 42 are positioned on the display item 14 such that each second coupler 42 is positioned to couple to a respective first coupler 40 to selectively couple the display item 14 to the stool 12.

In another embodiment of the invention, a recess 44 is positioned in the lower end 36 of the pot 30. The recess 44 is complementary to the sidewall 20 of the plate 16. The recess 44 is positioned to threadedly insert the plate 16 to couple the pot 30 to the stool 12.

Each of a pair of handles 46 is coupled to the pot 30. The handles 46 are opposingly positioned on the pot 30. The handles 46 are configured to be grasped in hands of the user to rotate the pot 30 relative to the plate 16 and to lift the pot 30.

In use the spikes 28 that are positioned on the extensions 22 are configured to insert into the surface, such as the lawn proximate to the grave site, to couple the stool 12 to the surface. The panel 38 that is positioned on the legs 18 is configured to cover the surface, such as the section of the lawn proximate to the grave site. The legs 18 are positioned on the plate 16 so that the stool 12 is configured to seat the user. The upper end 34 of the pot 30 is open so that the pot 30 is configured to insert the at least one plant. The handles 46 that are positioned on the pot 30 are configured to be grasped in the hands of the user to rotate the pot 30 relative to the plate 16 and to lift the pot 30. The recess 44 that is positioned in the pot 30 is positioned to threadedly insert the plate 16 to couple the pot 30 to the stool 12. The pot 30 and the at least one plant are configured to be exhibited upon the stool 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A convertible display stand to seating assembly comprising:

a stool comprising a plate and a plurality of legs, said legs being coupled to and extending from said plate, said plate being circularly shaped, said plate having a sidewall, said sidewall being externally threaded;

a display item configured for reversibly coupling to said plate, said display item comprising a pot, said pot comprising an annular wall extending between an upper end and a lower end, said upper end being open such that said pot is configured for inserting at least one plant, wherein said pot is positioned for coupling to said plate such that said pot and the at least one plant are configured for exhibiting upon said stool;

a recess positioned in said lower end of said pot, said recess being threaded and complementary to said plate for threadedly inserting said plate into said recess for coupling said pot to said stool; and wherein said legs are positioned on said plate such that said stool is configured for seating a user, wherein said display item is positioned for coupling to said plate such that said display item is configured for exhibiting upon said stool.

2. The assembly of claim 1, further including said plurality of legs comprising four said legs.

3. The assembly of claim 1, further including said legs extending arcuately from said plate.

4. The assembly of claim 1, further including a plurality of extensions, each said extension being coupled to and extending arcuately from a bottom end of a respective said leg such that said extension defines a spiral.

5. The assembly of claim 4, further including a plurality of spikes, each said spike being coupled to and extending from a respective said extension such that said spike is substantially perpendicular to said plate, wherein said spikes are positioned on said extensions such that said spikes are configured for inserting into a surface for coupling said stool to the surface.

6. The assembly of claim 1, further including said upper end being dimensionally larger than said lower end such that said annular wall is tapered.

7. The assembly of claim 1, further including a panel coupled to and extending between bottom ends said legs, wherein said panel is positioned on said legs such that said panel is configured for covering the surface upon which said stool is positioned.

8. The assembly of claim 1, further comprising:

a plurality of first couplers coupled to said plate;

a plurality of second couplers coupled to said display item, said second couplers being complementary to said first couplers; and wherein said second couplers are positioned on said display item such that each said second coupler is positioned for coupling to a respective said first coupler for selectively coupling said display item to said stool.

9. The assembly of claim 1, further including a pair of handles coupled to said pot, said handles being opposingly positioned on said pot, wherein said handles are positioned on said pot such that said handles are configured for grasping in hands of the user for rotating said pot relative to said plate and for lifting said pot.

10. A convertible display stand to seating assembly comprising:

a stool comprising a plate and a plurality of legs, said legs being coupled to and extending from said plate, wherein said legs are positioned on said plate such that said stool is configured for seating a user, said plate being circularly shaped, said plate having a sidewall, said sidewall being externally threaded, said plurality of legs comprising four said legs, said legs extending arcuately from said plate;

a plurality of extensions, each said extension being coupled to and extending arcuately from a bottom end of a respective said leg such that said extension defines a spiral;

a plurality of spikes, each said spike being coupled to and extending from a respective said extension such that said spike is substantially perpendicular to said plate, wherein said spikes are positioned on said extensions such that said spikes are configured for inserting into a surface for coupling said stool to the surface;

a display item configured for reversibly coupling to said plate, wherein said display item is positioned for coupling to said plate such that said display item is configured for exhibiting upon said stool, said display item comprising a pot, said pot comprising an annular wall extending between an upper end and a lower end, said upper end being open such that said pot is configured for inserting at least one plant, wherein said pot is positioned for coupling to said plate such that said pot and the at least one plant are configured for exhibiting upon said stool, said lower end being shaped complementarily to said plate, said upper end being dimensionally larger than said lower end such that said annular wall is tapered;

a panel coupled to and extending between said bottom ends said legs, wherein said panel is positioned on said legs such that said panel is configured for covering the surface upon which said stool is positioned;

a recess positioned in said lower end of said pot, said recess being complementary to said sidewall of said plate, wherein said recess is positioned in said pot such that said recess is positioned for threadedly inserting said plate for coupling said pot to said stool;

a pair of handles coupled to said pot, said handles being opposingly positioned on said pot, wherein said handles are positioned on said pot such that said handles are configured for grasping in hands of the user for rotating said pot relative to said plate and for lifting said pot; and wherein said spikes are positioned on said extensions such that said spikes are configured for inserting into the surface, such as the lawn proximate to the grave site, for coupling said stool to the surface, wherein said panel is positioned on said legs such that said panel is configured for covering the surface, such as the section of the lawn proximate to the grave site, wherein said legs are positioned on said plate such that said stool is configured for seating a user, wherein said upper end is open such that said pot is configured for inserting the at least one plant, wherein said handles are positioned on said pot such that said handles are configured for grasping in hands of the user for rotating said pot relative to said plate and for lifting said pot, wherein said recess is positioned in said pot such that said recess is positioned for threadedly inserting said plate for coupling said pot to said stool such that said pot and the at least one plant are configured for exhibiting upon said stool.

11. The assembly of claim 10, further comprising:

a plurality of first couplers coupled to said plate;

a plurality of second couplers coupled to said display item, said second couplers being complementary to said first couplers; and wherein said second couplers are positioned on said display item such that each said second coupler is positioned for coupling to a respective said first coupler for selectively coupling said display item to said stool.

* * * * *